US010828550B2

(12) United States Patent
Liang

(10) Patent No.: US 10,828,550 B2
(45) Date of Patent: Nov. 10, 2020

(54) SYSTEMS AND METHODS FOR A SMART TRAMPOLINE JUMPING MAT

(71) Applicant: Yi Liang, Lake Oswego, OR (US)

(72) Inventor: Yi Liang, Lake Oswego, OR (US)

(73) Assignee: Yi Liang, Lake Oswego, OR (US)

( * ) Notice: Subject to any disclaimer, the term of this patent is extended or adjusted under 35 U.S.C. 154(b) by 291 days.

(21) Appl. No.: 15/356,392

(22) Filed: Nov. 18, 2016

(65) Prior Publication Data

US 2017/0144052 A1 May 25, 2017

Related U.S. Application Data

(60) Provisional application No. 62/257,744, filed on Nov. 20, 2015.

(51) Int. Cl.
*A63B 71/06* (2006.01)
*A63B 5/11* (2006.01)
(Continued)

(52) U.S. Cl.
CPC ..... *A63B 71/0622* (2013.01); *A63B 5/11* (2013.01); *A63B 21/023* (2013.01); *A63B 2071/063* (2013.01); *A63B 2071/0655* (2013.01); *A63B 2207/02* (2013.01); *A63B 2220/00* (2013.01); *A63B 2220/17* (2013.01);
(Continued)

(58) Field of Classification Search
CPC ... A63B 71/0622; A63B 5/11; A63B 2230/01; A63B 2220/805; A63B 2220/51; A63B 2220/17; A63B 2207/02; A63B 2071/0655; A63B 2220/20; A63B 2220/806; A63B 2220/40; A63B 2071/063; A63B 2230/75; A63B 2225/50; A63B 2220/30; G06Q 50/01
See application file for complete search history.

(56) References Cited

U.S. PATENT DOCUMENTS 5,921,899 A 7/1999 Rose
7,297,089 B2 11/2007 Chen
(Continued)

FOREIGN PATENT DOCUMENTS

CA 2772801 9/2012
WO WO 2014/098628 6/2014

*Primary Examiner* — Loan B Jimenez
*Assistant Examiner* — Shila Jalalzadeh Abyaneh
(74) *Attorney, Agent, or Firm* — Aspire IP

(57) ABSTRACT

A smart trampoline jumping mat system is designed that has a jumping mat, a sensor or a set of sensors, a processor with wireless communication unit, and a handheld device with an application program running from the smart handheld device. The sensor or set of sensors can be used for sensing activity of a person or an object on the bounce members. The processor is used to acquire deflection data from the sensor or sensor group. Deflection data is then manipulated by the processor prior to being sent to the handheld device. The handheld device may include a processor, graphical user interfaces (GUI) to show the move meat of the juniper, and a speaker to generate audible feedback. A method to compute the height of a bounce is also presented. The deflection value is combined with data based on jumper's weight, jump period, and size of trampoline mat to determine the height of a bounce.

1 Claim, 9 Drawing Sheets

(51) Int. Cl.
*A63B 21/02* (2006.01)
*G06Q 50/00* (2012.01)

(52) U.S. Cl.
CPC ..... *A63B 2220/20* (2013.01); *A63B 2220/30* (2013.01); *A63B 2220/40* (2013.01); *A63B 2220/51* (2013.01); *A63B 2220/53* (2013.01); *A63B 2220/80* (2013.01); *A63B 2220/805* (2013.01); *A63B 2220/806* (2013.01); *A63B 2225/50* (2013.01); *A63B 2230/75* (2013.01); *G06Q 50/01* (2013.01)

(56) References Cited

U.S. PATENT DOCUMENTS 9,161,006 B1 * 10/2015 Wang ..... H04N 9/79
2002/0137598 A1 9/2002 Publicover et al.
2004/0077975 A1 4/2004 Zimmerman
2009/0111670 A1 4/2009 Williams
2010/0190608 A1 7/2010 Publicover et al.
2011/0034300 A1 2/2011 Hall
2012/0015334 A1 * 1/2012 Hamilton ..... A63B 71/0622 434/247
2012/0058808 A1 * 3/2012 Lockton ..... G07F 17/32 463/9
2012/0295763 A1 11/2012 Lin
2013/0106684 A1 * 5/2013 Weast ..... G06F 19/3481 345/156
2014/0087341 A1 * 3/2014 Hall ..... G09B 5/065 434/258
2014/0179492 A1 * 6/2014 Wilkins ..... A63B 71/0619 482/27
2014/0210613 A1 * 7/2014 Houvener ..... A63B 26/003 340/539.11
2015/0153374 A1 * 6/2015 Balakrishnan ..... G01P 13/00 702/178
2015/0321039 A1 * 11/2015 Howe ..... A63B 5/11 482/8
2016/0144239 A1 * 5/2016 Sclafani ..... A63B 24/0087 700/282

* cited by examiner

SYSTEMS AND METHODS FOR A SMART TRAMPOLINE JUMPING MAT

CROSS REFERENCE TO RELATED APPLICATION

This application claims the benefit of U.S. Provisional Patent Application No. 62/257,744, filed on Nov. 20, 2015.

FIELD OF INVENTION

The invention relates to techniques for measuring activity on a flexible mat of a trampoline with a wireless enabled electronic processor that includes at least one sensor to measure the deflection of the jumping mat relative to the plane formed by the undeformed mat, and a smart handheld device which connects to the processor for data communication. The wireless communication enabled electronic processor manipulates the data and determines the height of the bounce based on user's profile, while ignoring any sensor noise and false bounces. The processor transfers bounce data to the smart handheld device for purposes including but not limited to entertainment and exercise. Furthermore, the bounce data can be displayed through a graphical user interface (GUI) on handhold device to illustrate user's activities and provide user interaction. This interface can be used to play games on the handheld device which use input from both the processor and the user to determine outcomes. The program running on handheld devices being able to exchange data with a cloud service through internet, thus turning a local trampoline bounce sequence into to an internet trampoline game with social features.

BACKGROUND

Canadian patent publication CA 2,772,801 to Yjip Inc. and U.S. patent publication US2015/0321039 to John Robert Howe have described different methods to measure activities on the trampolines. They invented a trampoline including a frame and a jumping mat assembly that is supported by the frame to allow at least one user to bounce on the jumping mat. The trampoline also includes a sensor system that includes a plurality of sensors supported by the frame and/or the jumping mat assembly. The sensors are used to determine the status of a user or users on the trampoline. The main purpose of these inventions is to ensure the safety of the bouncers.

The previous inventions did not adequately solve the issue of differentiating between the two situations when a person is walking on the mat versus when the user is jumping on the mat. This lack of differentiation can result in false bounce detection by the sensor arrangement. Deflection of the jumping mat caused by walking on the trampoline should not be registered as a valid jump. This walking activity can be defined as a bounce of insufficient height. The insufficient bounce is a noise signal and should be filtered and ignored by the sensing unit. In another scenario, these patents failed to identify deflection of the jumping mat resulting from jumpers with different profiles, including user weight and trampoline size. For example, the deflection registered on the jumping mat from jumper weighing 100 lbs is quite different from that of a jumper weighing 200 lbs.

Personal communication, productivity, and entertainment devices such as tablets, smart phones, c-books, handheld game player or game controllers, portable media/email device, iPads, Netbooks, etc. (all referred to hereafter as "smart devices") are known to include features such as graphical user interfaces (GUI), touch screens, wireless connectivity, etc. These devices also are known to provide support for ancillary applications (referred to as "APP" thereafter), such as calendars, email, maps, navigation, or other user defined functions. Ancillary applications may be pre-installed in a smart device or may be made available for download by a user. After initial installation and configuration of such a smart device APP, a GUI may be provided by means of which a user may be enabled to issue operational commands to a user configured hardware. Disclosed herein are user-friendly and convenient GUI methods for facilitating command input/output for a smart trampoline mat.

From technology point of view, the previous inventions did not include smart handheld device and APP program to interactively work with the bouncers. None of the former inventions have combined a trampoline bounce event effectively with bounce height calculations and energy consumption calculations coupled with entertainment gaming. Most importantly, none of the prior art has included an internet-enabled cloud service technology which can turn a local trampoline game to an internet game with social features. None of the former inventions discuss the ability to upload or download user's historical data to a cloud service for global distribution of game data, or for an individual's personal activity tracking. This invention breaks the limitation of physical localization of trampoline and brings fan to users all over the world.

It is an object of preferred embodiments of the present invention to address some of the aforementioned disadvantages. An additional or alternative object is to at least provide the public with a useful choice, and make the previous invention useful.

SUMMARY OF THE INVENTION

A smart trampoline jumping mat system is provided which has a jumping mat, a sensor or set of bounce sensors, an electronic processor with communication unit, a handheld device with communication unit and an APP program running on the handheld device. The sensor or set of bounce sensors can be used for sensing activity of a person or an object on the bounce mat through deflection measurement. Sensor data is collected and sent to the local processor unit for calculation. The local process filters the data, removing sensor noise and calculating sufficient and insufficient jumps using jump height as a selection criteria. The local processor then sends data to the handheld device. The handheld device may then display the data, update and potential game scenario with the data, and/or upload the data to a cloud service for further processing and storage.

Using the data acquired, the local processor calculates user bounce data, such as bounce count, bounce frequency, bounce period, bounce time, and bounce height. The processor communication unit is the link between the local processor and the handheld device. An APP program running on the smart devices displays user calorie dissipation by using bounce data received and displays user profile, bounce data, game guidance, activities, etc., on the visual display of the smart device. The APP is also capable of registering single or multiple user's profile, storing all users' profile and personal history of bounce data locally in the memory of the smart device. Furthermore, the APP upload and download personal profile and bouncing activities to and from a cloud service. In the APP, a user can compare a pair of chosen user's bouncing action to start a competition. The APP applies cloud calculation to compare user's bouncing activity among other users so long as the users registered themselves through the APP or this APP's website. This invention turns a local trampoline to an open game over the interne and one of a social tool. This effectively brings more fun and exercise to any user from a local trampoline.

In an embodiment, a method of determining bounce height of a person or object on a flexible mat of a trampoline comprises a sensor arrangement comprising at least one sensor arranged at the periphery of the mat, the sensor or sensor group being configured to measure the local deflection of the mat in reference to the plane formed by the undeformed mat as a person or object bounces on the mat, such that the deflection value measured by the sensor corresponds to the height of the bounce. The sensor arrangement determining a bounce height based on the mat deflection signal, the size of the trampoline, and the weight of the person or object.

In another embodiment, a smart trampoline jumping mat system includes a flexible mat that is supported by the frame to allow at least one user or object to bounce thereon; a bouncing sensor unit or group that includes at least one sensor that is attached to the flexible mat at the periphery of the mat, generating a signal determined by the deflection of the mat relative to the plane formed by the undeformed mat a processor able to communicate with the sensor signal along with additional user inputs including user or object weight and trampoline size in order to determine the height of a bounce by a user or object on the flexible mat a wireless transmitter incorporated into the processor able to communicate to a separate smart handheld device. A wireless enabled handheld device, capable of exchanging data with the processor, displaying data to the user, and exchanging data with a cloud service.

The trampoline further comprises a set of trampoline games for a user to play locally or through cloud service, through which the users are able to share their jumping data and competition results through cloud service, or to invite online friend to start a game. At least one sensor is one of an accelerometer, a photo sensor, a vibration sensor, a video camera, a strain gage, and a piezoelectric transducer. If more than two sensors are applied, the sensors are in odd numbers (1, or 3, or 5, or, 7 or 9) and are dispensed evenly around the trampoline peripheral so that any active bounce on any spot of the trampoline mat will be monitored and leaves no dead spot on the trampoline mat. The bouncing sensor unit or groups are attached to the trampoline mat or the springs around the jumping mat. The bouncing signal measured by the bouncing sensor unit or groups are, but not limited to, vibration, displacement, speed, acceleration, deflection, displacement or piezoelectricity signals is activated by bouncing activity of the jumping mat. The bouncing signal is/are used to calculate deflection of the jumping mat, and thus to calculate personal jumping height, bounce count, bounce frequency, bounce period, bounce time, etc. The bouncing signal has been conditioned to remove high frequency disturbance and low frequency disturbance before being applied by the processor to calculate bouncing activity. User's weight, gender, size of trampoline and deflection of the trampoline mat are considered parameters to estimate jumping height. The processor, wherein it acquires the measured data from the sensor group and manipulates information to be exchanged with handheld device. The smart handheld device is in forms of a tablet, smart phone, handheld PC, wherein a memory, a touch screen, a user graphical interface, or a wireless communication method (Bluetooth, or local wireless network, or radio frequency, or infrared) are features of the device. The smart device utilizes at least one or any combination of Bluetooth, Radio Frequency, and Infrared as communication link with the bouncing sensor unit or groups, thus to enable information exchange with the bouncing sensor unit or groups. The information exchanged between smart device and bouncing sensor unit or groups are, but not limited to: bouncing count, bouncing height estimation, calorie estimation, user weight, user age, user gender, etc. The APP program is a program installed into the smart device and runs in the smart device. The APP program has a graphical interface to display personal bouncing activities, but not limited to: bounce count, bounce frequency, bounce time, bounce height, calorie estimation, etc. The APP program has a function to display game center, game help, game rules, and to invite other people to the game, and display game procedure or game outcome. The graphical interface displays jumping motion in live of jumper when a camera is connected to the sensor group. The camera takes motion pictures of the jumper and transfers to the APP program, the Application program restores the image in local memory of the smart device. The APP program with access for user to register personal profile, such as user's name, weight, age, height, gender, address, phone number, etc., but not limited to above. The APP program with an access for user to upload and save their profile and jumping data to a cloud service. The APP program is capable of record user historical jumping data such as total jumps over a long-time, total calories burned, etc., and displays user's history data and current data on the graphical interface. The APP program with an access for user to link their social media account such as Facebook, Twitter, WeChat, Instagram etc., to share bounce data, jumping picture and video within friend circle or for public view. The personal profile registered is used to calculate jumper's calorie consumption per jump and total calorie dissipation in a time period according to the bounce data measured by the sensor group. The Application program provides access for the user to compose a sequence of actions to exert on the trampoline and disclose the sequence of action to circle of his/her friend(s) or to public review. The Application program provides access for the user to start or accept invitation to/from other user for a competition or game by completing the sequence of action as the user defined. The competition or game includes a series of jumping actions on the trampoline defined by APP or by user himself/herself customizing. These action or rules are included in game center of the APP. The App can define a routing for the user, the routing includes all actions the user must finish. The APP program provides access to the user to choose preset series of jumping tasks defined in the program, such as jumping 100 times in 100 seconds, or jumping height being over 1 meter continuously for 50 jumps, etc., not limited to above mentioned. The competition or game where the App is capable to create customized rule for partial or all users in match or wants to be in match, over a predefined time frame. The competition or game where the App is capable to record all users' data and put on the ranks. The rank can be updated during a time period, such as every day or every 1 mins. Every user can know his/her rank. The APP program provides windows to display bounce data of game players or competitors. The trampoline mat system comes with audio speaker, which is used to speak out commands, operation guides, personal performance, bounce acitivities game guidance, or any other output to amuse or prompt the users.

BRIEF DESCRIPTION OF THE DRAWINGS

The drawings described in this section are for illustrative purposes only and are to clarify and improve understanding of the embodiment of this invention. The drawings and figure listed are not all possible implementations of the current invention and thus not intended to limit the scope of the present disclosure

LEGAL WORDING DEFINITIONS

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

DETAILED DESCRIPTION OF THE INVENTION

Figure 1:
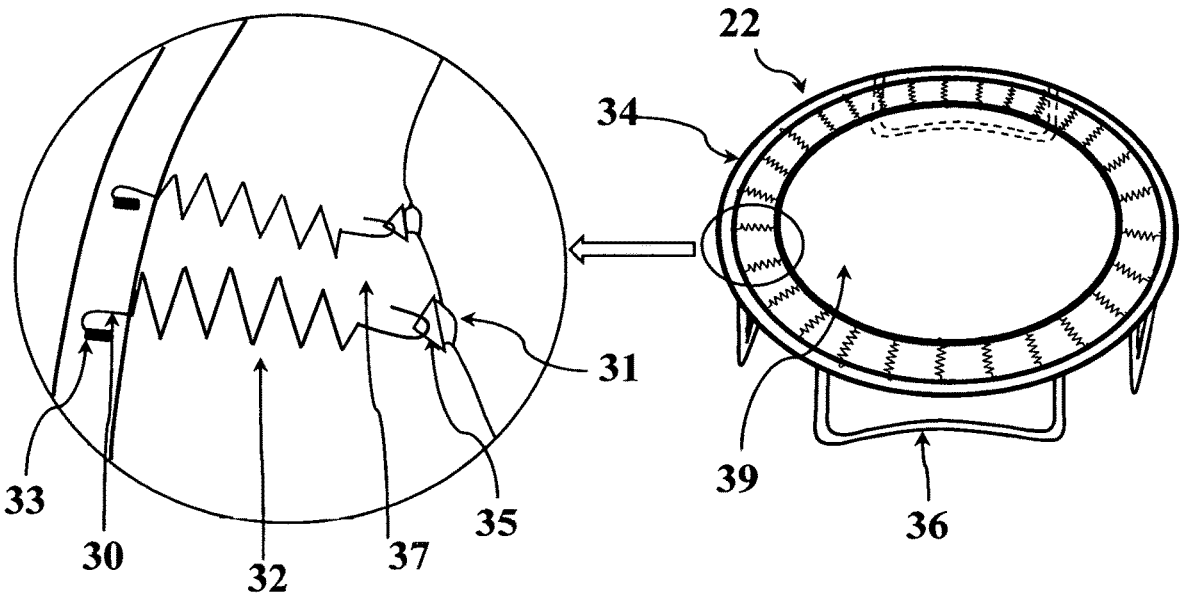
FIG. 1 (PRIOR ART)
FIG. 1 is a outline view of prior art of trampoline which is applied for this embodiment.

Referring to prior art FIG. 1, there is illustrated one embodiment of a conventional trampoline 22, which includes a trampoline frame 34, to support the basic structure thereof. There is mounted to the frame 34, a jumping bed 31, a plurality of coil springs 32, and a plurality of upright legs 36. The legs 36 are adapted to be disposed uprightly on a ground surface and vertically coupled to the frame 34 in a spaced relationship to each other. The frame 34 shape, circular in this embodiment, defines a bed mounting space 37 or opening. The jumping bed 31, is mounted in the space 37, and includes a trampoline mat member 39 with a peripheral spring attachment portion 33. There is a plurality of coupling members 35, like grommets, peripherally mounted to the attachment portion 33, and designed to releasably couple to one end of the coil springs 32 respectively. A second opposite end of each spring 32 is designed to be releasably coupled to a plurality of frame mounting members 30, like a hook, ring or eye design, which are peripherally mounted in a spaced apart manner to the inner circumference of the frame 34. Thus, the jumping bed is resiliently suspended off the ground and held in the mounting space 37 by the frame 34 and the springs 32 to allow users to jump thereon without hitting the ground.

Figure 2:
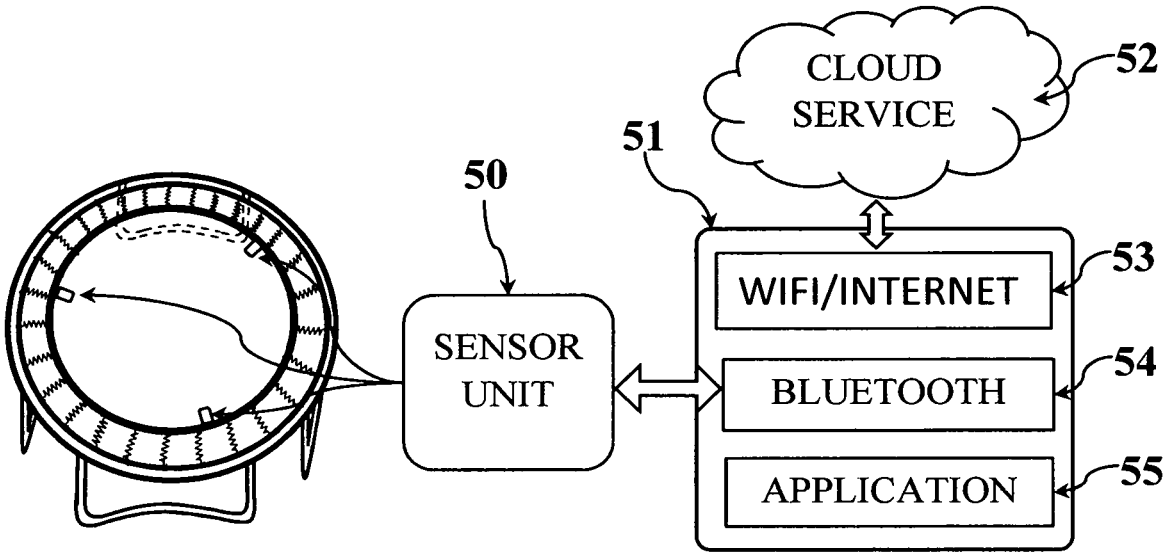
FIG. 2 is an illustration of one embodiment of the present invention.

As shown in FIG. 2, the trampoline mat 39, the bounce sensor 50, the local electronic processor (bounce sensor unit), the handheld device 51, the cloud service 52, the wireless/internet port 53, the Bluetooth port 54, and the Application program 55 comprised the smart trampoline system and provide a variety of functionality and entertainment to the game of trampoline.

Figure 3:
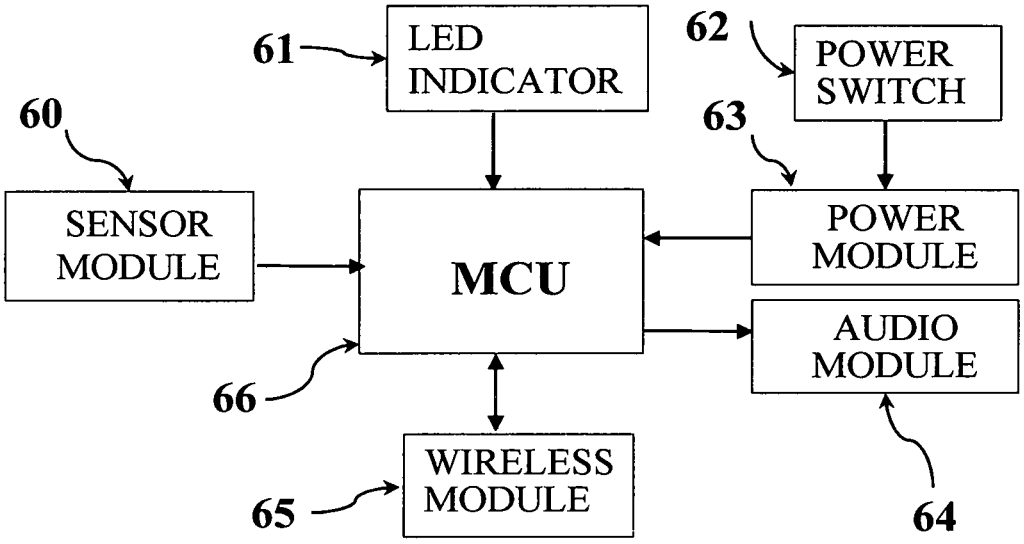
FIG. 3 is one design of the bouncing sensor unit diagram.
Figure 5:
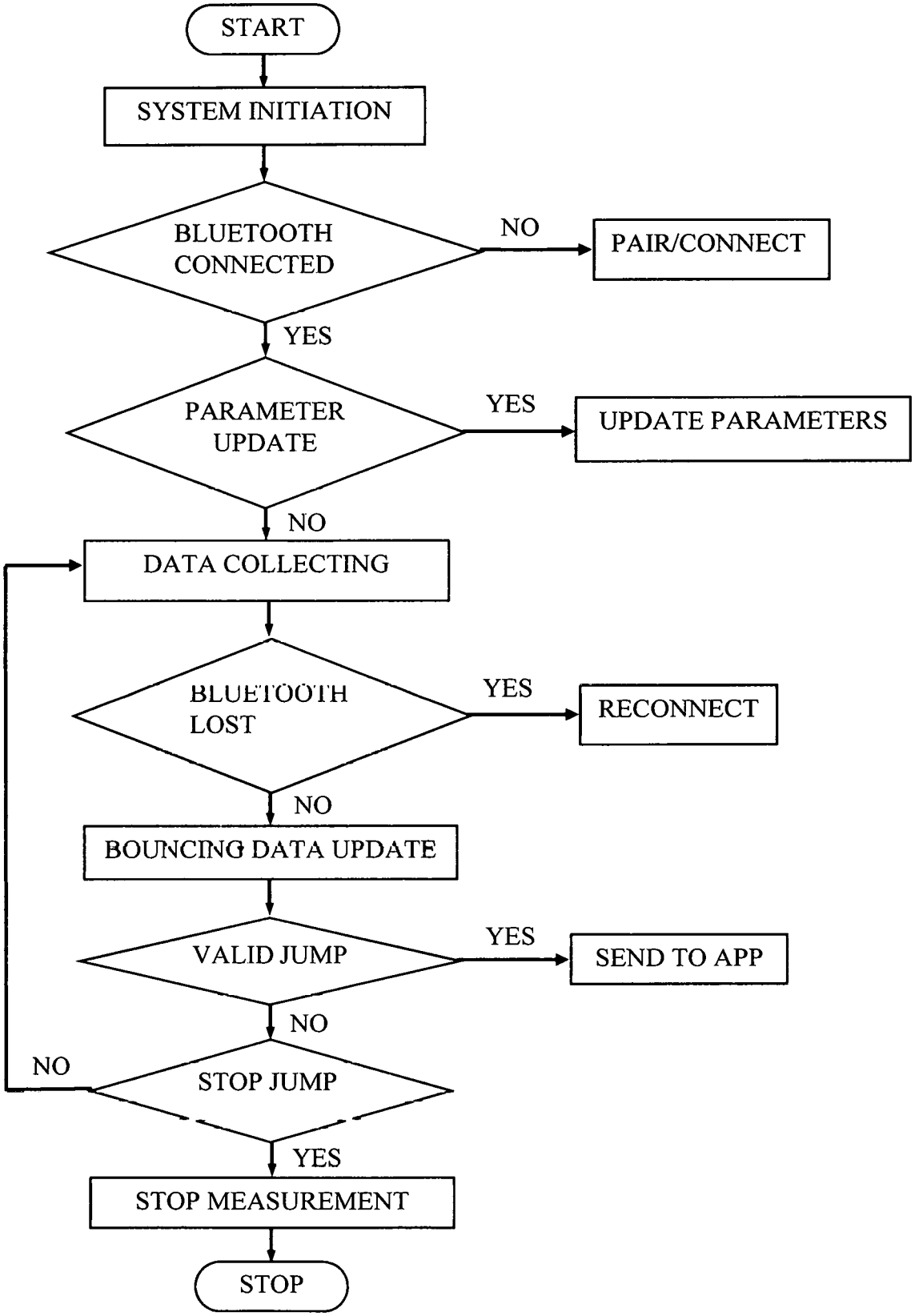
FIG. 5 is the program flowchart of the bouncing sensor unit which measures deflection of the jumping mat and exchange data with smart handheld device.

A trampoline mat has at least one bounce sensor unit 50 that are mounted on the mat or under the mat, illustrated in FIG. 3. The bounce sensor unit measure deflection of the flexible mat relative to the plane formed by the undeformed mat, thus to measure activity of the bouncer on the jumping mat. A bounce sensor unit 50 includes sensor module 60, power switch 62, power module 63, microprocessor 66, wireless communication module 65, LED indicators 61, and audio module 64. The MCU process communication and measurement procedures. The bouncing sensor unit measurement program flowchart is displayed in FIG. 5.

The bouncing sensor unit or units 50 are configured to measure value corresponding to deflection of the jumping mat as a person moves on the mat. The term deflection as used in this claim is related to a mat deflection signal or value measured relative to the plane of the undeformed mat.

There are several suitable techniques for fixed or removable mounting the sensors in association with the trampoline. These preferred methods of mounting will be further described below.

Figure 6:
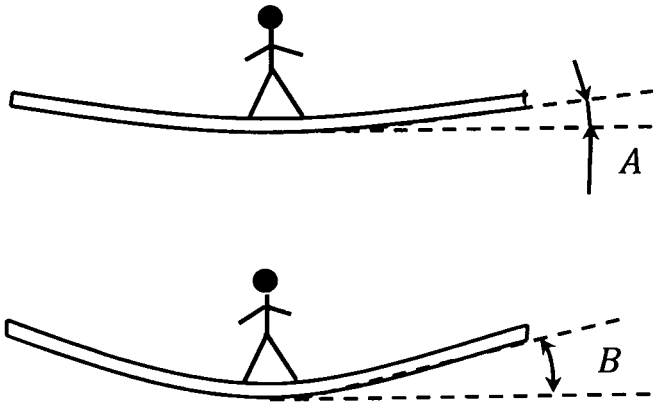
FIG. 6 is illustration of deflection aroused by jumper when standing still on the trampoline vs jumping on the trampoline.

As sketched in FIG. 6, when a person is standing on the jumping mat, the initial deflection value is defined as A, while a person jumps on the mat, the deflection value will be registered as a bigger value, called B in this scenario. The difference deflection between B and A, i.e., equation B-A, is possibly a valid deflection caused by the bouncing activity.

For any jump to be considered a valid bounce, the deflection registered by this jump minus the initial deflection must be bigger than a threshold value $B_0$, that is:

$$(B-A)>B_0,$$

where the threshold $B_0$, is not only related to jumping mat and springs' elasticity, but also related to jumper's weight m and trampoline size D. For a predefined trampoline, the weight becomes the only parameter to affect the threshold value.

Figure 7:
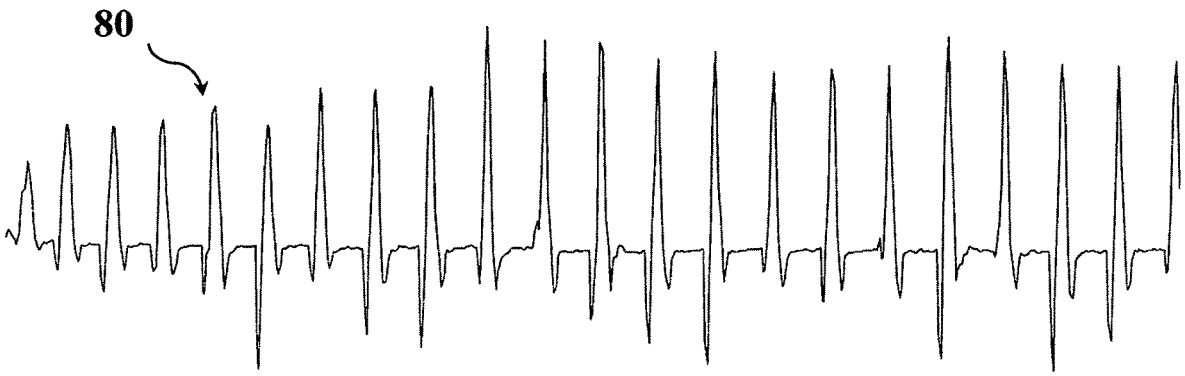
FIG. 7 is a typical embodiment of deflection measured from trampoline mat while jumping.
Figure 8:
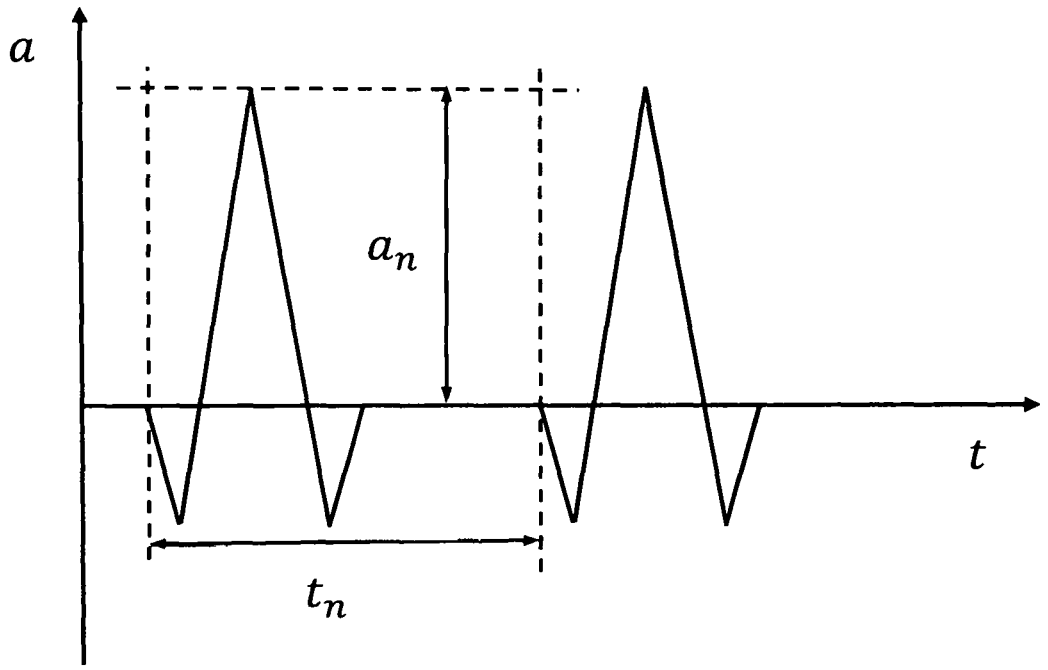
FIG. 8 is a simplified deflection segment of one jump in time domain.

A typical dynamic deflection curve 80 measured from bouncing sensor unit is printed in FIG. 7. For simplicity, a typical jump can be represented by FIG. 8, where $a_n$ can be acceleration, force or impact amplitude of the nth jump and $t_n$ the period of this jump. The deflection of the jumping mat is related to jump impact/force/acceleration a, weight of the jumper m, and period of the jump t, as described by the equation:

$$B=\mu mat$$

where, a is value measured by the bouncing sensor unit, m is a fixed value for each jumper and t can be measured by analyzing the output curve shape of each jump measured by sensor. μ is a constant can be normalized using least square method and statistics method by a vast variety of experiment from different jumper at a wide range of weight μ is also related to size of trampoline.

Deflection on jumping mat can be categorized to different levels ($B_k$), starting from minimum measurable deflection $B_0$, notation k is grade of deflection. If a is the acceleration measured on the jumping spot, then deflection of mat is simplified to:

$$D=\mu ft$$

therefore, the deflection is a linear function of pseudo-impact of jumper f*t. Here we call this pseudo-impact since the period t is not the time of contact but time of whole jump period. This equation complies with trampoline physics:

1. The longer time the jumper in the air, the bigger the jump, and vice versa;

2. The higher the deflection, the higher the jump, and vice versa;
3. The bigger the jump, the more moment or acceleration or impact on the trampoline mat, thus generating higher value of deflection;
4. The more impact on the trampoline, the bigger the deflection of the jumping mat;
5. For same height of jump, heavier person generating higher deflection value.

From above, it is safely to conclude that deflection is a function of jumper's weight, jump period, and force/acceleration measured on trampoline mat, for a predefined stiffness of trampoline mat and springs.

Figure 9:
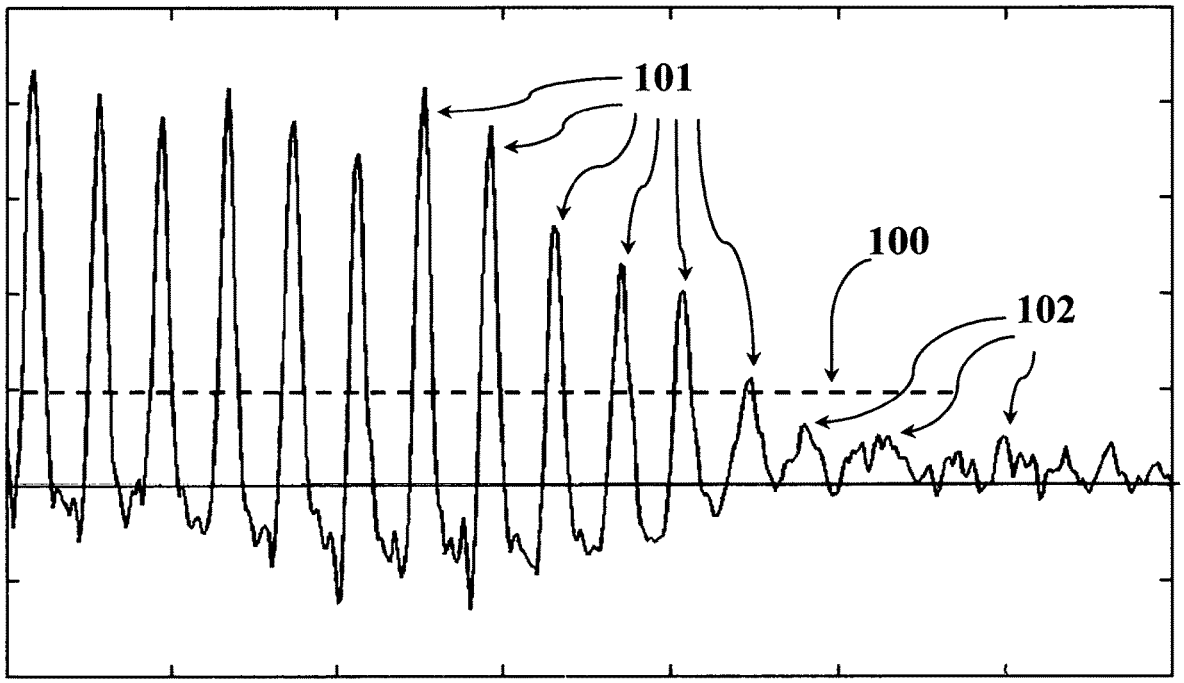
FIG. 9 is a sketch of identifying valid jump from invalid jump by threshold value.

The lowest grade of deflection ($B_0$) can be decided by experiment of the minimal detectable jump. As shown in the FIG. 9, any deflection measured above the dashed line 100 considered a valid jump 101; other than that, the jump is not considered valid 102.

Figure 4:
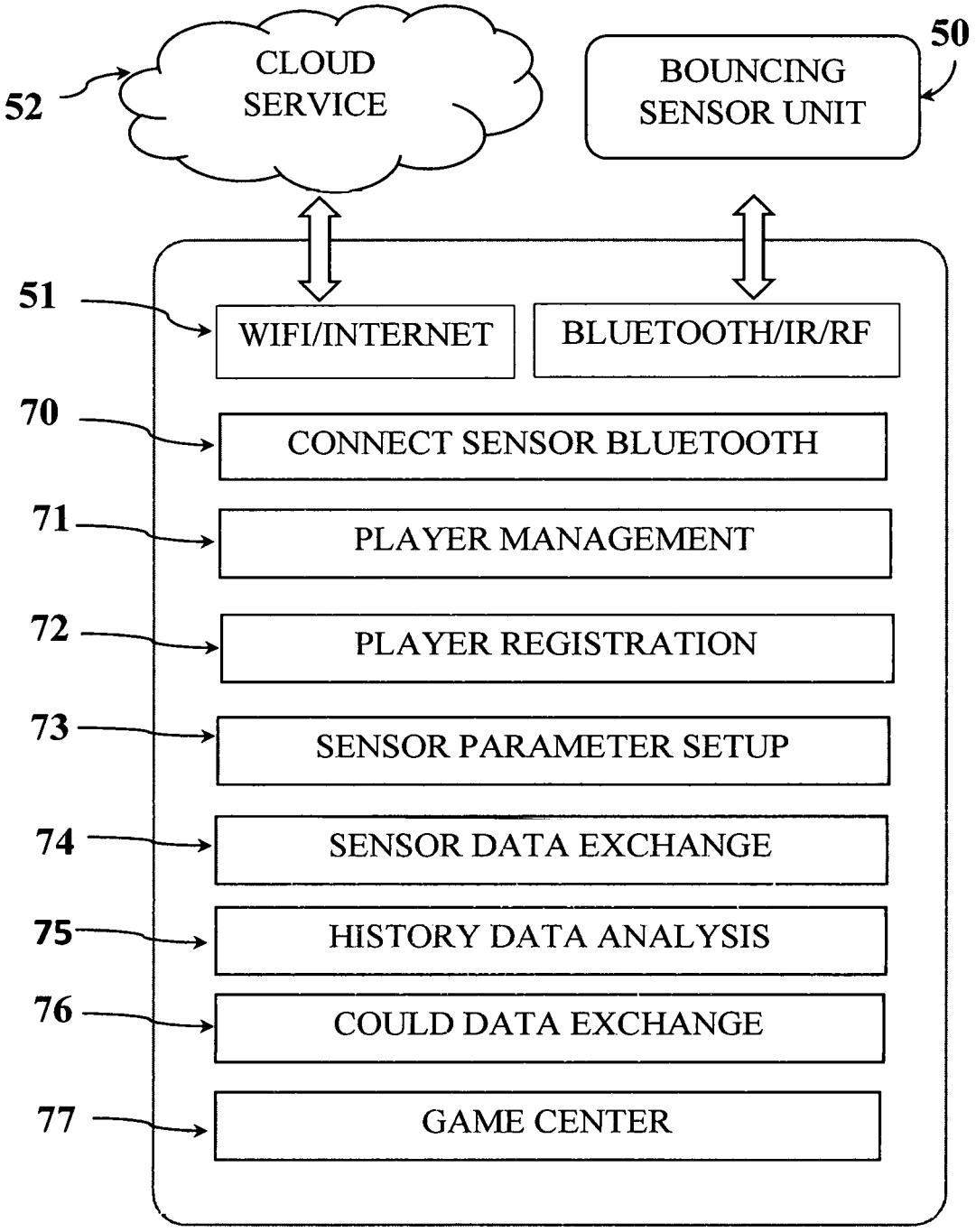
FIG. 4 is the APP block function illustration which runs in a smart device.

Preferably the smart device has a processor, a memory unit, a display, and a user input facility. The user input facility includes a touch screen, a keyboard etc. A processor of the smart device 51 is included as control core of the system. The communication device may be in forms of Bluetooth or radio frequency (RF) or infrared radiation (IR) 54 to talk with electronic handheld device and APP program 55 installed on a smart device. The function block of the APP 55 running in the smart device is detail described in FIG. 4. The APP program includes functions of pair with Bluetooth/RF/IR of sensor unit 70, player list management 71, player registration 72, setup or change sensor parameter 73, receive bouncing data from bouncing sensor unit 74, player current data and history data analysis 75, Exchange data and information with cloud service 76, and game center with multiple games 77, as described in FIG. 4.

The APP program is installed on a smart device with touch screen or sets of keys which could slide or push to interacts with the users. A user can register individual profile in the APP and the APP will upload the user's profile to cloud service. The user's profile may include but is not limited to, user's name, weight, gender, age, height, address, phone, email, etc.

The sensor and processor installed on the trampoline will apply measured dynamics of the user on the trampoline to calculate bouncing time, bounce frequency, bouncing count, bounce height. Furthermore, by interacting with the APP program, the system is capable of calculating user's calorie dissipation.

To add more fun to the game of trampoline, this invention also includes interne competition along with local trampoline completion. As we know, when a group of users jump at one trampoline one by one in sequence, they can start a competition game in sequence to find out the winner. For example, the winner is the one who bounce the most count in a 3 minute, but each bounce has to be over 1 meter's height to be counted as a valid jump. Or the winner is the one who finishes 100 jumps in shortest time, in condition that each jump being over 1 meter. Of course, the set height can be some other number as agreed by the jumper. In the APP, this function is distributed via cloud service worldwide, i.e., the jumpers are not limited to a physically one location trampoline, they can jump on their own trampoline and upload their jumping data and parameter to the cloud service, thus being involved with the competition. Jumpers can invite their friends or other cloud service members to start a set rules of competition.

The APP program running on the handheld device is capable of, but not limited to:

1. Provide a set of game for users to choose;
2. Provide rules for users to choose,
3. Provide interface for user to customize their own game or sequence of actions and upload to their circle.
4. Upload their jumping video and data to Facebook, Twitter, Google Circle, WeChat, or other social platform to show to their friends.
5. Provide interface for any user to initiate a public game or sequence of action which allows other users to joining.

The APP program is capable of recording local user's jumping data and parameter; and save the data and jumping parameter to local drive and/or uploading to cloud service. The APP program displays local user's jumping data on the handheld screen, such as count of bouncing, frequency of bouncing, bouncing time, bouncing height, etc. User can choose information to be displayed on the screen by setting.

The APP is capable of alerting the user of the closest trampoline they can use to participate in cloud games if those trampolines are registered in the cloud service.

The APP is capable of acting as a local game center which provides users a set of games to choose to play alone or with others from local area or remote cloud service. The followings is an example of a possible game:

Game 1: In a set time, the winner is who finish the most jumps, all jumps has to be over a set height.

Games in the game centers of the APP is not limited to the above mentioned.

CITATIONS

US20110034300A1, 26 Jun. 2012, David Hall, Sensor, control and virtual reality system for a trampoline US20100190608A1, Jul. 29, 2010, Jumpsport, Inc., Trampoline system US20020137598A1, Sep. 26, 2002, Mark Publicover, Jon Greiner, J. Publicover, Byron Bertsch, Trampoline or the like with enclosure U.S. Pat. No. 5,921,899A, Jul. 13, 1999, Amelia T. Rose, Pneumatic exerciser US20040077975A1, Apr. 22, 2004, Zimmerman Jeffrey C., Systems and methods for motion analysis and feedback US20090111670A1, Apr. 30, 2009, Julian D Williams, Walk simulation apparatus for exercise and virtual reality U.S. Pat. No. 7,297,089B2, Nov. 20, 2007, Samuel Chen, Lighted trampoline US20150321039A1, Nov. 12, 2015, John Robert Howe, Board & Batten International Inc., Method and System of Measuring an Activity of a Person on a Flexible Mat of a Trampoline US20120295763A1, Nov. 22, 2012, YJIP, Inc., Trampoline with feedback system

The invention claimed is:

1. A smart trampoline jumping mat system, comprising:

a flexible mat supported by a frame, wherein the flexible mat is resiliently suspended to avow a deformation of the mat through a bounce of at least one user on a top surface of the mat;

a bounce sensor unit including at least one sensor coupled to the flexible mat at a periphery of the mat, wherein the bounce sensor unit is configured to obtain repeated measurements based on deflections of the mat over time, the deflections being relative to a plane formed by the mat without the deformation, wherein the bounce sensor unit is attached to springs around the mat, and wherein the springs resiliently suspend the mat;

computational equipment configured for estimating a height of the bounce of the at least one user based on the measurements and at least one additional parameter;

a wireless transmitter coupled to the computational equipment for communicating data based on the height to a smart handheld device separate from the computational equipment, wherein the handheld device is configured to receive the data, present information based on the data on a display of the handheld device, and communicate information based on the data with a cloud service, wherein the data is further based on a count of the bounce, an estimation of a calorie count, and a personal profile of the at least one user including a weight of the at least one user, an age of the at least one user, and a gender of the at least one user, and wherein data of the personal profile is used to calculate calorie consumption per jump and total calorie dissipation in a time period according to the measurements by the bounce sensor unit; and non-transitory computer readable medium comprising instructions configured for one or more games or competitions playable by the at least one user using the system with other users through the cloud service, wherein the cloud service includes a sharing of jumping data and competition results data;

instructions configured for access for the at least one user to choose preset series of bounce tasks defined in the non-transitory computer readable medium;

instructions configured for access for the at least one user to link social media account of the at least one user to share one or more of bounce data, bounce picture or video for public or friend circle view;

instructions configured for access for the at least one user to compose a sequence of actions to exert on the mat and disclose the sequence of actions through the social media account;

instructions configured for access for the at least one user to start or accept invitation to/from the other users for a game or competition of the one or more games or competitions using the system by completing the sequence of actions;

instructions configured to create customized rule for partial or all users in the one or more games or competitions or wants to be in the one or more games or competitions, over a predefined time frame; and instructions configured to display windows for bounce data of the users, and wherein the non-transitory computer readable medium is installed into the handheld device.

* * * * *